US008479317B2

(12) United States Patent
Nguyen

(10) Patent No.: US 8,479,317 B2
(45) Date of Patent: Jul. 9, 2013

(54) FLIP-UP SHIRT COLLAR BRACE

(76) Inventor: Tuan Nguyen, Tustin, CA (US)

( * ) Notice: Subject to any disclaimer, the term of this patent is extended or adjusted under 35 U.S.C. 154(b) by 280 days.

(21) Appl. No.: 12/819,832

(22) Filed: Jun. 21, 2010

(65) Prior Publication Data

US 2011/0307995 A1 Dec. 22, 2011

(51) Int. Cl.
*A41B 3/00* (2006.01)

(52) U.S. Cl.
USPC ..... 2/132; 24/900.1; 2/117

(58) Field of Classification Search
USPC ..... 2/132, 160, 60, 116, 203, 323, 336, 2/262, 255, 142, 137–139, 134, 129, 98, 2/117; 24/3.1, 3.11, 3.12, 900.1; 63/18–20; 40/755, 756, 748, 754
See application file for complete search history.

(56) References Cited

U.S. PATENT DOCUMENTS

| | | | | | |
|---|---|---|---|---|---|
| 322,462 | A | * | 7/1885 | Maddox | 24/53 |
| 763,097 | A | * | 6/1904 | Epple | 24/13 |
| 768,120 | A | * | 8/1904 | Fisher | 40/1.6 |
| 889,549 | A | * | 6/1908 | Roy | 40/1.6 |
| 1,112,640 | A | * | 10/1914 | Mix | 63/19 |
| 1,300,179 | A | * | 4/1919 | Lipp | 2/91 |
| 1,363,381 | A | * | 12/1920 | Antelotti | 2/132 |
| 1,386,424 | A | * | 8/1921 | Reiter | 24/485 |
| 1,429,804 | A | * | 9/1922 | Tooker | 24/331 |
| 1,660,181 | A | * | 2/1928 | Voskerchian | 63/20 |
| 1,761,834 | A | * | 6/1930 | King et al. | 2/245 |
| 1,874,145 | A | * | 8/1932 | Van Cura | 2/132 |
| 2,060,643 | A | * | 11/1936 | Steele | 24/578.11 |
| 2,129,491 | A | * | 9/1938 | Chilson | 63/19 |
| 2,273,072 | A | * | 2/1942 | Steele | 24/331 |
| 2,276,592 | A | * | 3/1942 | Reitman | 359/519 |
| D139,767 | S | * | 12/1944 | Davidson | D11/43 |
| 2,646,668 | A | * | 7/1953 | Rinehart | 63/33 |
| 2,659,892 | A | * | 11/1953 | Sharp et al. | 2/132 |
| 2,744,255 | A | * | 5/1956 | Portias | 2/132 |
| 2,983,926 | A | * | 5/1961 | Turner | 2/232 |
| 3,075,202 | A | * | 1/1963 | Rubio | 2/132 |
| 3,200,413 | A | * | 8/1965 | Vaughan | 2/60 |
| 3,686,692 | A | * | 8/1972 | Snare et al. | 2/132 |
| 3,686,894 | A | * | 8/1972 | Handler et al. | 63/19 |
| 4,118,803 | A | * | 10/1978 | Blau | 2/132 |
| 4,558,469 | A | * | 12/1985 | Richter | 2/60 |
| 4,583,379 | A | * | 4/1986 | Rotondo et al. | 63/33 |
| 4,922,553 | A | * | 5/1990 | Morrone | 2/132 |
| 5,063,643 | A | * | 11/1991 | Siegel | 24/335 |
| 5,085,060 | A | * | 2/1992 | Matsushita | 63/14.1 |

(Continued)

FOREIGN PATENT DOCUMENTS

GB 2210548 A * 6/1989

*Primary Examiner* — Richale Quinn
(74) *Attorney, Agent, or Firm* — Steins & Associates, P.C.

(57) ABSTRACT

The preferred brace resides invisibly beneath and behind the user's shirt collar when not in use. When desired, the user can flip up his or her collar and an appendage from the brace, and thereby hold the shirt collar up. The brace includes an envelope-shaped member that attaches either permanently or detachably to the collar band of the user's shirt. The envelope forms an internal chamber between a pair of opposing wall members that are made from resilient material, such as plastic or the like. The base envelope is defined by an aperture formed therein, and through which protrudes a brace tab that is operable between a down position and an up position. In the up position, the brace tab will prop the users shirt collar flap up so as to cover the back of the user's neck.

18 Claims, 5 Drawing Sheets

U.S. PATENT DOCUMENTS

| | | | | |
|---|---|---|---|---|
| 5,441,188 | A * | 8/1995 | Rosenstein | 224/264 |
| 6,089,422 | A * | 7/2000 | Gibson | 223/84 |
| 6,253,385 | B1 * | 7/2001 | Fields | 2/246 |
| D464,287 | S * | 10/2002 | Potter et al. | D11/91 |
| D474,127 | S * | 5/2003 | Potter et al. | D11/81 |
| 7,409,730 | B2 * | 8/2008 | Boos | 2/132 |
| D640,042 | S * | 6/2011 | Biancamano | D2/859 |
| 2007/0192998 | A1 * | 8/2007 | Ryder | 24/1 |
| 2008/0229472 | A1 | 9/2008 | Maggs | 2/60 |
| 2009/0183293 | A1 | 7/2009 | Gulisano | 2/98 |
| 2011/0252542 | A1 * | 10/2011 | Huang | 2/256 |

* cited by examiner

FLIP-UP SHIRT COLLAR BRACE

BACKGROUND OF THE INVENTION

1. Field of the Invention

This invention relates generally to apparel and accessories therefore and, more specifically, to a Flip-up Shirt Collar Brace.

2. Description of Related Art

Since golf is generally an outdoor sport (indoor facilities are rare), golfers understandably spend quite a bit of time outdoors. It follows that avid golfers spend a lot of time in the sun, since the tendency is to avoid playing golf in inclement weather.

The attire of choice for golfers (male and female) seems to be short-sleeved, collared shirts (sometimes referred to as "polo" shirts). These shirts provide the desired style, while still giving golfer the requisite comfort and range of motion necessary to play what can be a physically demanding activity.

What polo shirts don't provide is an adequate level of protection for the back of the golfer's neck. Most golfers wear ballcaps or visors to prevent overexposure to their face, but it really isn't comfortably feasible to wear any sort of shield or cover for the back of the neck. Since the collar of the typical polo shirt is soft (for comfort reasons), they generally won't stay up if they are flipped up to cover the wearer's neck. Since the style and wearability of the conventional polo shirt is otherwise very desirable, what is left is to add the structure to the conventional collared shirt (such as a polo shirt) that allows the wearer to flip up the shirt collar and have it remain propped up in that position until the wearer flips the collar back down.

SUMMARY OF THE INVENTION

In light of the aforementioned problems associated with the prior devices, it is an object of the present invention to provide a Flip-up Shirt Collar Brace. The preferred brace will reside invisibly beneath and behind the user's shirt collar when not in use. When desired, the user should be able to flip up his or her collar and an appendage from the brace, and thereby hold the shirt collar up. The brace should include an envelope-shaped member that attaches either permanently or detachably to the collar band of the user's shirt. The envelope should create an internal chamber between a pair of opposing wall members that are made from resilient material, such as plastic or the like. The base envelope should be defined by an aperture formed therein, and through which protrudes a brace tab that is operable between a down position and an up position. In the up position, the brace tab should prop the users shirt collar flap up so as to cover the back of the user's neck.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Flip-up Shirt Collar Brace.

Figure 1:
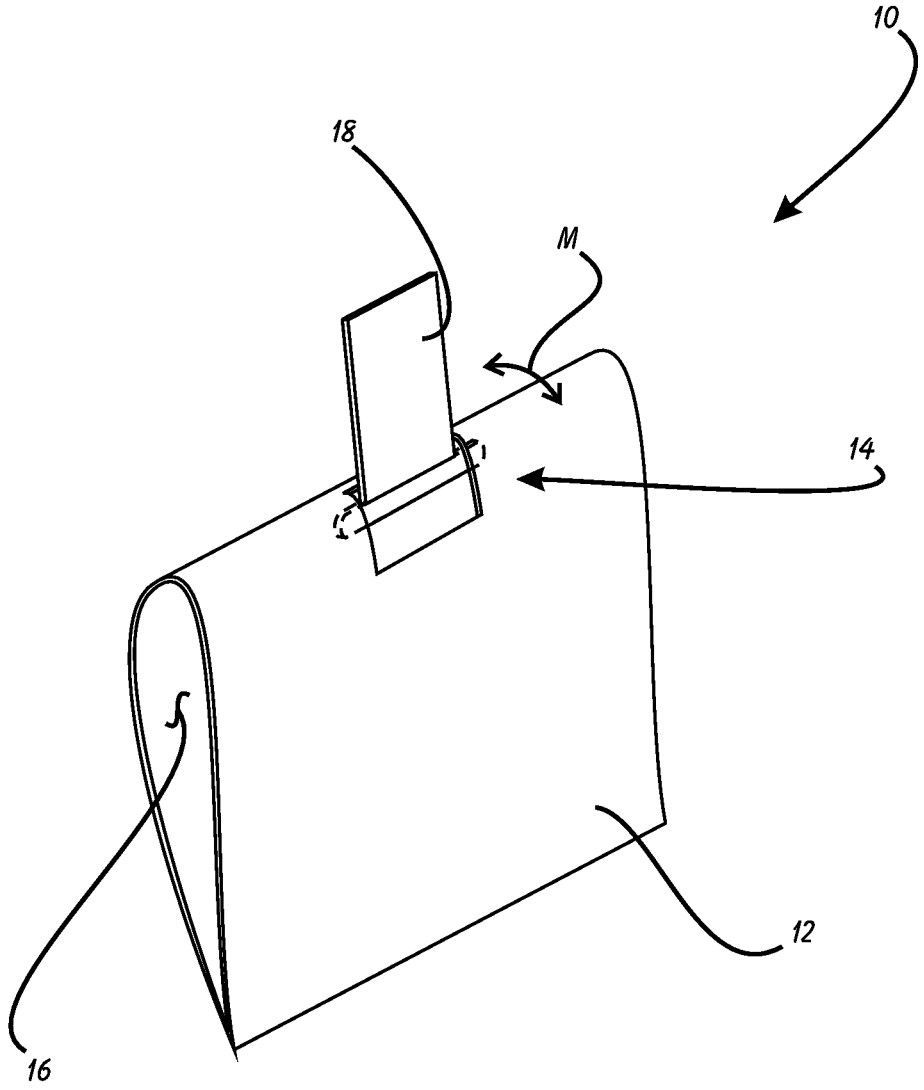
FIG. 1 is a perspective view of a preferred embodiment of the flip-up shirt collar brace of the present invention.

The present invention can best be understood by initial consideration of FIG. 1. FIG. 1 is a perspective view of a preferred embodiment of the flip-up shirt collar brace of the present invention. The flip-up shirt collar brace 10 is composed of two elements: the base envelope 12 and the brace tab 18. As will be discussed more further in the following figures, the brace 10 is designed to attach to the back of the collar of a conventional polo shirt. It can be attached by pins or Velcro or other conventional means or it might even be sewn on to the shirt while that shirt is in production. The purpose for the brace 10 is to prop up the back of the collar of the polo shirt but also allow the collar to be flipped back down when coverage for the back of the neck is not desired. In order to serve that purpose, the base tab 18 is permitted to move in the direction M from a down position to a flipped up position where it will either allow the collar to be folded down as normal or will hold it up to protect the wearer's neck. The purpose of the base envelope 12 is to generally create the structure to support the brace tab and to hold it into whatever position the wearer selects.

The base envelope 12 is typically made from a substantially stiff but flexible material such as plastic is defined by an aperture 14 at its top side and by an internal chamber or bore 16 passing through it. While the base envelope 12 is shown here as rectangular shape, it should be realized that other shapes and designs might be employed depending on the particular collar to which the envelope 12 is being attached. If we now to turn to FIG. 2, we can examine the individual elements of this device 10 in detail.

Figure 2:
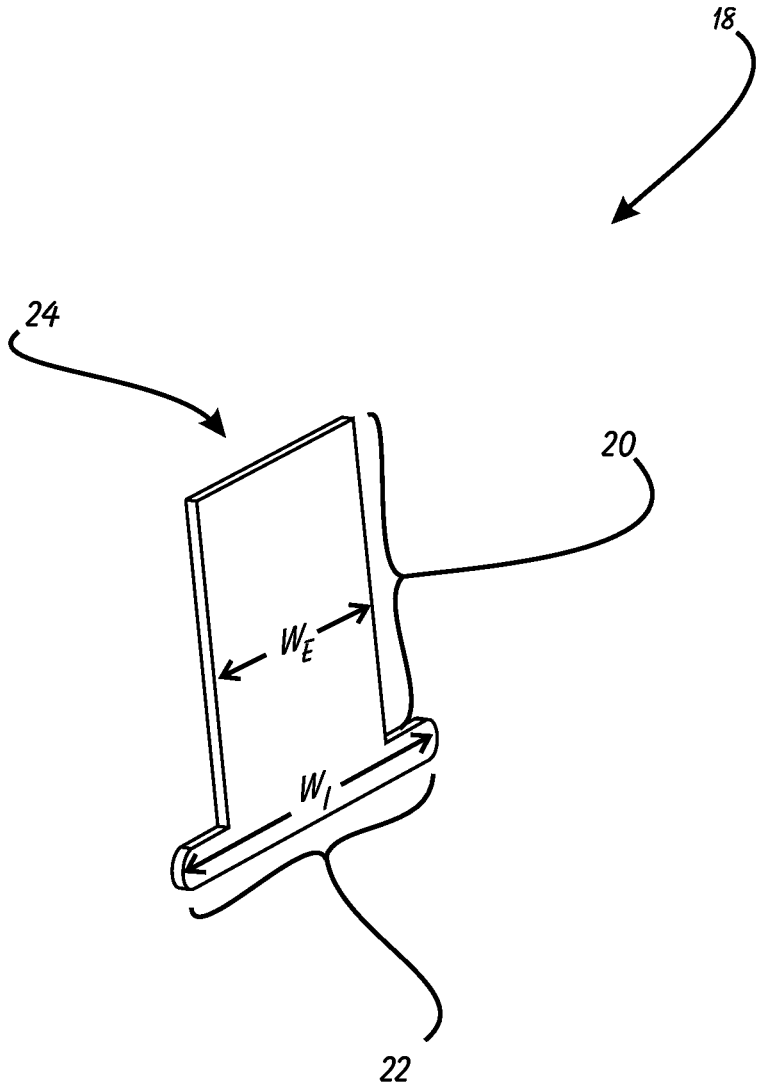
FIG. 2 is a perspective view of the brace tab of the brace of FIG. 1.

FIG. 2 is a perspective view of the brace tab of the brace of FIG. 1. The brace tab 18 is also typically made from a stiff yet flexible material such as plastic. It has a generally T-shape with an upper external section 20 and a lower internal section 22. The external section 20 is defined by a width $W_E$ that is less than or equal to the width of the aperture (see FIG. 1). The internal section 22 is defined by a width $W_I$ that is wider than the aperture (see FIG. 1) so that it will retain the brace tab within the base envelope during operation. As should be apparent, the external section 20 is named as such because it protrudes out from the base envelope (see FIG. 1). The internal section 22 has its name because it is located within the internal chamber or bore of the base envelope. The distal end 24 of the brace tab 18 is designed to point upwardly from the brace when the collar is flipped up and point downwardly from the brace when the collar is flipped down. We will now turn to FIGS. 3A and 3B to further explore the details of the base envelope.

Figure 3A:
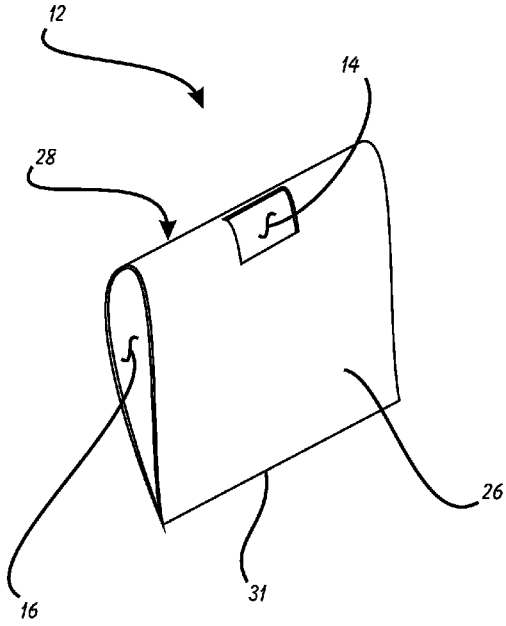
FIGS. 3A and 3B are front a rear perspective views of the base envelope of the brace of FIG. 1.
Figure 3B:
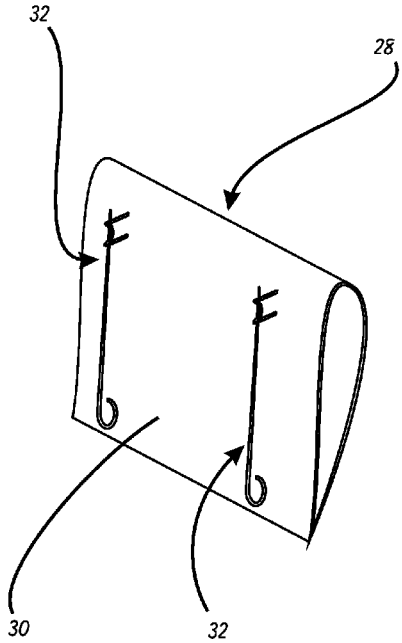

FIGS. 3A and 3B are front a rear perspective views of the base envelope of the brace of FIG. 1. The base envelope, as discussed previously, is typically made from thin plastic and in this case has a generally rectangular face. On the side designed to be facing away from the back of the user's neck, the envelope 12 is defined by an outer wall member 26. The aperture 14 is formed partially in the outer wall member 26 extending upwardly to the upper ridge 28. The internal chamber or bore 16 is formed between the inner wall member 30 and the outer wall member 26. In this version, the inner and outer wall members 30 and 26 respectively are parts of a single sheet of stiff plastic having a bend to form the upper ridge and meeting at its bottom edge 31 where the two members 26 and 30 are attached to one another. One or more attachment devices 32 are located on the interface of the inner wall member 30. Here the attachment devices 32 are a pair of safety pin-like devices that can function so that the base envelope 12 is pinned to the back of the collar of the user. As discussed previously, other attachment means may be employed including thread (i.e. the envelope 12 is sewn to the collar), or buttons or Velcro among others. We will now turn to FIGS. 4A through 4C in order to discuss the biasing functionality provided by the design of this invention.

Figures 4A, 4B, 4C:
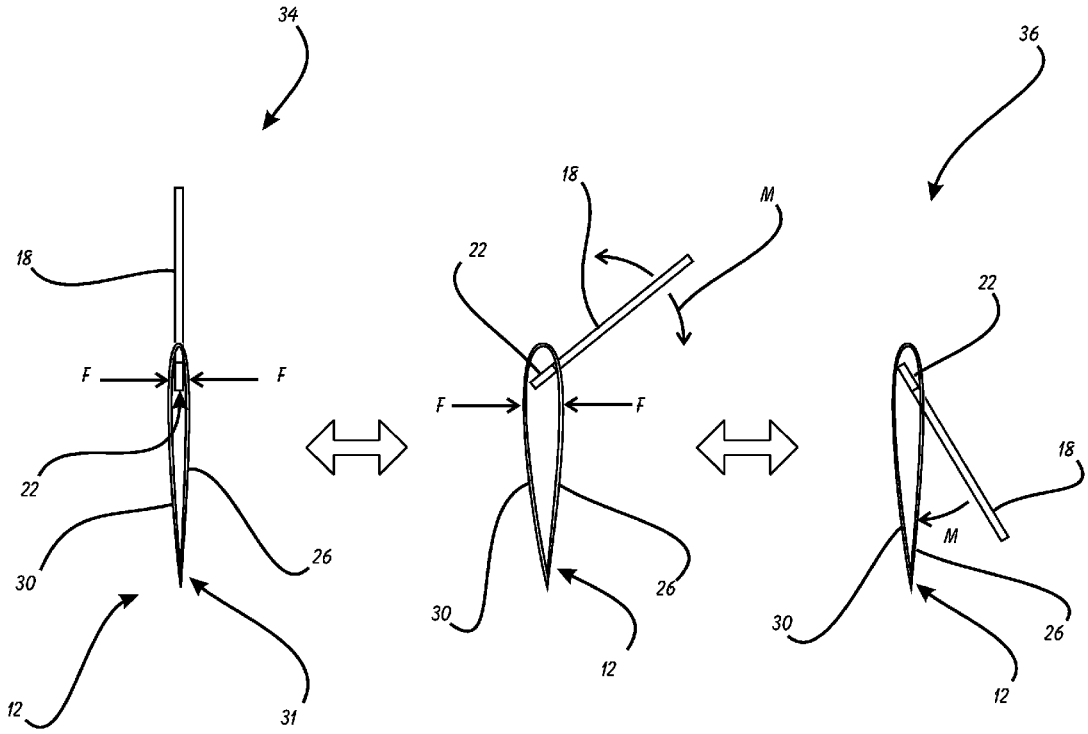
FIGS. 4A-4C are side views of the brace of FIGS. 1-3.

FIGS. 4A-4C are side views of the brace of FIGS. 1-3. As shown in FIG. 4A, the brace 10 is in the up position 34. In this case, the brace tab 18 is extending upwardly. It is retained in this position because the internal section 22 is being pinched between the inner wall 30 and the outer wall 26 of the brace envelope 12. This force F tends to pinch together because the bottom edge 31 of the inner and outer wall members 30 and 26 tends to want to keep those wall members 26 and 30 held against one another. Because the base envelope 12 is made from flexible material such as plastic, the members 26 and 30 will be allowed to push apart, however they will continue to be urged back towards one another if deflected from their normal resting position. FIG. 4B shows that the brace tab 18 has begun to be moved in the direction M or in the downward direction. As can be seen, the internal section 22 as it twists begins to force the inner and outer wall members 30 and 26 away from one another. Again, this tends to increase the forces F pinching towards one another. Finally, in FIG. 4C the internal section 22 has passed the midpoint of its rotation and therefore the forces F of the inner and outer wall members 30 and 26 will pinch the internal section thereby forcing the brace tab 18 in direction M thus forcing the brace 10 into the down position 36. Finally we will turn to FIGS. 5A and 5B to observe the brace 10 as it operates with a conventional shirt.

Figure 5A:
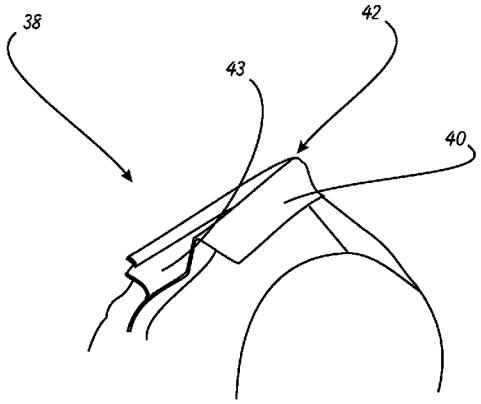
FIGS. 5A and 5B are perspective views of a shirt having the brace of FIGS. 1-4 installed therein.
Figure 5B:
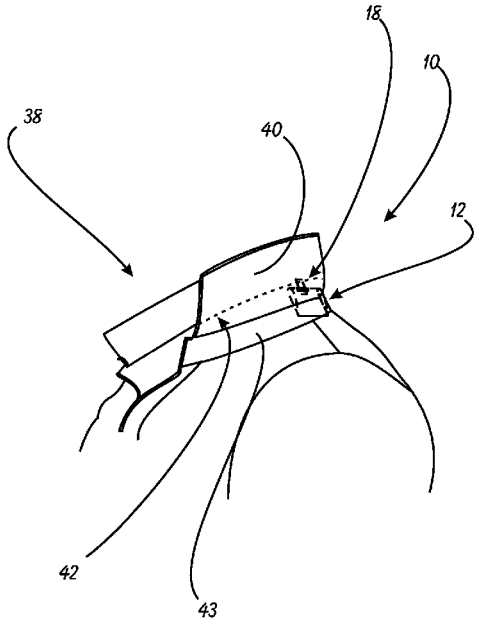

FIGS. 5A and 5B are perspective views of a shirt having the brace of FIGS. 1-4 installed therein. In FIG. 5A, the shirt 38, such as a polo shirt, has its collar flap 40 folded down. In FIG. 5B the user has decided to flip up the collar such as to provide sun protection to the back of the neck. The collar flap 40 is flipped up after which the user simply flips up the brace tab 18 on the collar brace 10. As shown in FIGS. 4A through 4C, the brace tab 18 will be held in the up position as shown here until such time as the wearer flips it back down. The brace tab 18 extends high enough to hold the collar flap 40 in the up position and allows the wearer to engage in fairly vigorous physical action and still successfully hold the collar flap 40 in the up position. The base envelope 12 is attached by the attachment means such as that shown in FIG. 3B to the back of the collar such that the upper ridge (see FIG. 3A) is below the fold 42 of the collar flap 40. As such, when the collar flap 40 is folded down such as it is in Figure A, the collar brace 10 will be invisible.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A brace for a shirt collar, the collar defined by a collar band and a collar flap extending upwardly therefrom, said collar flap having a center portion and terminating in two opposing tips, the brace comprising:

a base envelope attachable to the collar band, said envelope defining an internal bore formed therein; and a brace tab extending from said internal bore formed in said base envelope through a brace aperture formed in a wall thereof, said brace tab operable to extend upwardly in a first position wherein said brace tab props said center portion of said collar flap upwardly, wherein said brace tab is further operable to rotate about said brace aperture downwardly to a second position wherein said center portion of said collar flap is allowed to extend downward from said collar band.

2. The brace of claim 1, wherein said base envelope comprises:

an outer wall;

an inner wall;

said internal bore formed between said outer and inner wall; and said brace aperture is formed in at least one said wall and through which said brace tab extends.

3. The brace of claim 2, wherein said brace tab comprises:

an external section terminating in a distal end and defined by a external width;

an internal section opposing said distal end and defined by an internal width; and wherein said internal width exceeds said external width.

4. The brace of claim 3, wherein said base envelope aperture defines an aperture width, and said external width being less than said aperture width and said internal width being greater than said aperture width.

5. The brace of claim 4, wherein said brace tab is a "T" shape.

6. The brace of claim 5, wherein said inner wall is attached to a rear portion of said collar band.

7. The brace of claim 6, wherein said outer wall and said inner wall meet at a top end in an upper ridge, said aperture formed in said upper ridge and extending into said outer wall.

8. The brace of claim 7, wherein said base envelope is formed from a sheet of thin plastic.

9. The brace of claim 8, wherein said brace tab is formed from a sheet of thin plastic.

10. The brace of claim 9, wherein said base envelope is detachably attached to said collar band.

11. The shirt collar of claim 10, wherein said base envelope aperture defines an aperture width, and said external width being less than said aperture width and said internal width being greater than said aperture width.

12. The shirt collar of claim 11, wherein said brace tab is a "T" shape.

13. The shirt collar of claim 12, wherein said inner wall is integral to a rear portion of said collar band, whereby said brace tab extends from an area adjacent to a top edge defined by said collar band.

14. The shirt collar of claim 13, wherein said outer wall and said inner wall meet at a top end in an upper ridge, said aperture formed in said upper ridge and extending into said outer wall.

15. The shirt collar of claim 14, wherein said brace tab and said base envelope are each formed from a single sheet of thin plastic.

16. A shirt collar, comprising:

a collar band, defined by a back central portion and terminating in opposing ends;

a collar flap extending upwardly from said collar band, said collar flap defined by a back central portion and terminating at each opposing end in a collar a tip, said back central portions being relatively aligned, and each said opposing end being adjacent to one said collar tip; and a collar brace for propping up the back central portion of said collar flap, the brace comprising:

a base envelope attachable to the back central portion of said collar band; and a brace tab extending through an aperture formed in a wall of said base envelope, said brace tab operable to extend upwardly in a first position wherein said brace tab props said back central portion of said collar flap upwardly, and is further operable to extend downwardly to a second position wherein said collar flap is allowed to extend downward from said back central portion of said collar band.

17. The shirt collar of claim 16, wherein said base envelope comprises:

an outer wall;

an inner wall;

an internal bore formed between said outer and inner wall; and an aperture formed in at least one said wall through which said brace tab extends.

18. The shirt collar of claim 17, wherein said brace tab comprises:

an external section terminating in a distal end and defined by a external width;

an internal section opposing said distal end and defined by an internal width; and wherein said internal width exceeds said external width.

* * * * *